US008104211B2

(12) United States Patent
Darian

(10) Patent No.: US 8,104,211 B2
(45) Date of Patent: Jan. 31, 2012

(54) BATTERY POWERED MOUNTING RAIL

(76) Inventor: Rubik Darian, Glendale, CA (US)

( * ) Notice: Subject to any disclaimer, the term of this patent is extended or adjusted under 35 U.S.C. 154(b) by 210 days.

(21) Appl. No.: 12/386,707

(22) Filed: Apr. 21, 2009

(65) Prior Publication Data

US 2010/0192446 A1 Aug. 5, 2010

Related U.S. Application Data

(63) Continuation-in-part of application No. 12/322,779, filed on Feb. 5, 2009, now Pat. No. 7,975,419.

(51) Int. Cl.
*F41C 27/00* (2006.01)

(52) U.S. Cl. ..... 42/90; 42/84; 42/124; 89/37.04; 463/50; 463/51; 362/110

(58) Field of Classification Search ..... 42/72, 84, 42/85, 124, 127, 128, 90, 54; 89/37.04; 463/50, 463/51; 362/110–114
See application file for complete search history.

(56) References Cited

U.S. PATENT DOCUMENTS

| | | | | | |
|---|---|---|---|---|---|
| 3,854,231 | A | * | 12/1974 | Broyles | 42/84 |
| 4,009,536 | A | * | 3/1977 | Wolff | 42/84 |
| 4,134,223 | A | * | 1/1979 | Hillenbrandt et al. | 42/84 |
| 4,152,754 | A | * | 5/1979 | deFilippis et al. | 362/113 |
| 4,236,348 | A | * | 12/1980 | DuLac | 446/485 |
| 4,329,803 | A | * | 5/1982 | Johnson et al. | 42/84 |
| 4,586,715 | A | * | 5/1986 | Scolari et al. | 463/50 |
| 4,718,187 | A | * | 1/1988 | Blake | 42/84 |
| 4,830,617 | A | * | 5/1989 | Hancox et al. | 434/21 |
| 5,233,776 | A | * | 8/1993 | Hessey | 42/54 |
| 5,533,292 | A | | 7/1996 | Swan | |
| 5,704,153 | A | * | 1/1998 | Kaminski et al. | 42/70.11 |
| 5,896,691 | A | * | 4/1999 | Kaminski et al. | 42/70.11 |
| 6,490,822 | B1 | | 12/2002 | Swan | |
| 6,931,775 | B2 | * | 8/2005 | Burnett | 42/72 |
| RE40,216 | E | | 4/2008 | Swan | |
| 7,421,818 | B2 | | 9/2008 | Houde-Walter | |
| 7,627,975 | B1 | | 12/2009 | Hines | |
| 2006/0288626 | A1 | * | 12/2006 | Kim | 42/73 |
| 2008/0134562 | A1 | | 6/2008 | Teetzel | |
| 2008/0190002 | A1 | | 8/2008 | Hines | |
| 2009/0013580 | A1 | | 1/2009 | Houde-Walter | |
| 2009/0031606 | A1 | | 2/2009 | Robinson et al. | |
| 2009/0108589 | A1 | * | 4/2009 | Racho | 290/1 R |
| 2010/0031552 | A1 | * | 2/2010 | Houde-Walter | 42/72 |
| 2010/0083553 | A1 | * | 4/2010 | Montgomery | 42/84 |
| 2010/0192448 | A1 | * | 8/2010 | Darian | 42/84 |

* cited by examiner

*Primary Examiner* — Michael David
(74) *Attorney, Agent, or Firm* — James E. Brunton

(57) ABSTRACT

A fire arm that includes a mounting rail having remotely powered electrical connectors with which modified prior art tactical accessories, such as tactical lights, night vision devices, laser sighting modules and the like can be interconnected. More particularly, the mounting rail of the invention includes electrical connectors that are operably interconnected with a relatively large, long life battery mounted in the stock of the firearm.

4 Claims, 7 Drawing Sheets

BATTERY POWERED MOUNTING RAIL

CROSS-REFERENCE TO RELATED APPLICATIONS

This is a Continuation-In-Part of U.S. application Ser. No. 12/322,779 filed Feb. 5, 2009 now U.S. Pat. No. 7,975,419.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention relates generally to firearm systems that include rail connectors for mounting various types of tactical accessories. More particularly, the invention concerns a firearm system that includes an electrically powered rail connector to which modified tactical accessories can be removable interconnected 2. Description of Related Art Including Information Disclosed Under 37 CFR 1.97 and 1.98

In recent years, a wide variety of mounts for military and civilian weapons have been developed which permit the mounting of various types of tactical accessories, such as telescopic sights, tactical lights, night vision devices, laser sighting modules, reflex sights and the like. A very popular rail connector is the so called Picatinny rail, which is typically affixed to the barrel or stock of the firearm for mounting accessories thereon.

The Picatinny rail comprises a series of ridges with a T-shaped cross-section interspersed with flat spacing slots. Tactical accessories are generally mounted on the rail either by sliding them on from one end or the other by means of a so called "rail-grabber" which is clamped to the rail with bolts, by thumbscrews or levers, or onto the slots between the raised sections.

In order to provide a stable platform, the Picatinny rail is provided with the spacing slots that give the rail considerable room to expand and contract lengthwise without distorting its shape. The Picatinny locking slot width is 0.206 in (5.232 mm). The spacing of slot centers is 0.394 in (10.008 mm) and the slot depth is 0.118 in (2.997 mm).

A somewhat similar prior art mounting rail is the Weaver rail. The only differences between the Picatinny rail and the Weaver rail are the size of these slots and the fact that they are standardized. Weaver rails have a slot width of 0.180 in (4.572 mm), but are not necessarily consistent in the spacing of slot centers. Because of this, accessories can be and are designed to fit on both Weaver rails and Picatinny rails.

Several major handgun manufacturers, such as Springfield Armory, Glock, SIG and many others, have made handguns with a Picatinny mounting rail formed on the pistol frame. The mounting rail has been used for mounting white lights, infrared and laser illuminating devices and telescopic sights. A typical mounting rail design is described in U.S. Pat. No. 5,881,486, issued to Bilgeri et al. Bilgeri et al. discloses a longitudinal mounting rail for a telescopic sight for use on a hand-held firearm, comprising a casing which accommodates breech parts, a stock which is attached to the casing, and a barrel which is detachably connected to the casing. In order to avoid the disadvantages of the conventional telescopic sight fitting and to allow the entire weapon to have a neat and practical shape, the casing forms a casing extension at the front beyond the connection to the barrel and a longitudinal rail is integrally formed at the top on the casing and on the casing extension as a mounting for the telescopic sight. The casing parts are made of light metal alloy. The longitudinal rail has a dovetail profile on which two clamps are guided that hold the telescopic sight. The Bilgeri et al. longitudinal rail has grooves in the transverse direction at specific intervals. These grooves offer space for clamping screws that fix the clamp. This allows the optical axis of the telescopic sight to be positioned very close to the barrel axis.

Many of the prior art tactical accessories, such as tactical lights, night vision devices, laser sighting modules and the like, typically embody small dry cell batteries that provide a source of electrical power to the device. These dry cell batteries are, by necessity, small and have limited capacity and life. This is highly undesirable when the accessories are used in the field under combat conditions because if the battery fails, the accessory becomes useless unless and until the battery is replaced. It is this drawback that the present invention seeks to overcome by providing a novel mounting rail that includes remotely powered electrical connectors to which modified prior art tactical accessories can be readily interconnected. In the preferred form of the invention, the electrical connectors of the mounting rail are interconnected with a relatively large, long life battery that is mounted in a stock of the firearm. With this construction, modified tactical accessories, which include suitable interconnection means to allow the accessory to be interconnected with the electrical connectors of the mounting rail, can be used in the field without fear of short-term battery failure.

BRIEF SUMMARY OF THE INVENTION

By way of brief summary, the present invention concerns an apparatus for mounting an electrically powered tactical device on a firearm having a barrel portion and a stock portion. In one form of the invention, the apparatus comprises a longitudinally extending mounting rail affixed to the barrel portion of the firearm. The mounting rail includes a body portion, having a base and a plurality of spaced apart ridges extending outwardly from the base, the ridges defining a plurality of longitudinally spaced apart grooves extending in a transverse direction. The apparatus further comprises first and second electrical connectors extending through the plurality of spaced apart ridges and longitudinally of the mounting rail. In the preferred form of the invention, the first and second electrical connectors are uniquely connected to the battery that is housed within the stock portion of the firearm.

With the forgoing in mind, it is an object of the present invention to provide a novel mounting rail for use with firearms that includes remotely powered electrical connectors with which modified prior art tactical accessories, such as tactical lights, night vision devices, laser sighting modules and the like can be interconnected. More particularly it is an object of the invention to provide a novel mounting rail of the character described in which the electrical connectors are operably interconnected with a relatively large, long life battery mounted in the stock of the firearm.

Another object of the invention is to provide a novel mounting rail as described in the preceding paragraphs in which the electrical conductors comprise first and second electrically conductive wires that extend longitudinally through the spaced apart ridges of the mounting rail so that the conductive wires can be accessed by the tactical accessories through the grooves defined by the spaced apart ridges.

Another object of the invention is to provide a novel mounting rail of the character described in which the spaced apart ridges are substantially the same height as the ridges of the Picatinny rail.

Another object of the invention is to provide a novel mounting rail as described in the preceding paragraph in which the spaced apart grooves of the mounting rail are substantially the same depth as the depth of the grooves of the Picatinny rail.

Another object of the invention is to provide a novel mounting rail of the class described that is readily interchangeable with the prior art Picatinny and Weaver rails.

Another object of the invention is to provide a novel improved mounting rail that is of simple construction and one that can be easily used with appropriately modified tactical accessories.

Another object of the invention is to provide a novel mounting rail as described in the preceding paragraphs that can be easily and inexpensively manufactured.

Another object of the invention is to provide a novel firearm system that comprises in combination a firearm having a stock and a connector rail mounting portion. Mounted within the stock is a conventional dry cell battery. Affixed to the connector rail mounting portion is a longitudinally extending mounting rail having first and second electrical connectors that extend longitudinally of the rail. Forming a part of the firearm system is an electrically powered tactical accessory that is removably connected to the mounting rail and uniquely draws its power from the first and second electrical connectors of the mounting rail.

Another object of the invention is to provide a novel firearm system of the class described that comprises in combination a firearm having a stock and a connector rail mounting portion. Mounted within the stock is a conventional dry cell battery as well as novel means for charging the dry cell battery.

These and other objects of the invention will be realized by the novel improved mounting rail illustrated in the drawings and described in the specification that follows.

DETAILED DESCRIPTION OF THE INVENTION

Definitions: As used herein the following definitions have the following meanings.

Picatinny Rail

The Picatinny rail comprises a mounting rail for use with firearms that is provided with a series of ridges with a T-shaped cross-section interspersed with flat spacing slots. Tactical accessories are generally mounted on the rail either by sliding them on from one end or the other, by means of a so called "rail-grabber" which is clamped to the rail with bolts, by thumbscrews or levers, or onto the slots between the raised sections.

Weaver Rail

The Weaver rail is a mounting rail that is somewhat similar to the Picatinny rail. The primary differences between the Picatinny rail and the Weaver rail are the size of the slots and the fact that they are standardized. Weaver rails have a slot width of 0.180 in (4.572 mm), but are not necessarily consistent in the spacing of slot centers.

Tactical Accessory

Tactical accessory as used herein means any firearm accessory that can be mounted to a conventional prior art Picatinny or Weaver mounting rail.

Electrically Powered Tactical Accessory

As used herein, electrically powered tactical accessory means any accessory that can be mounted to a conventional prior art Picatinny or Weaver mounting rail that includes electrically powered components such as tactical lights, night vision devices, laser sighting modules, reflex sights and the like.

Electrical Connector

Electrical connector means any type of connector that is capable of carrying an electric current.

Figure 1:
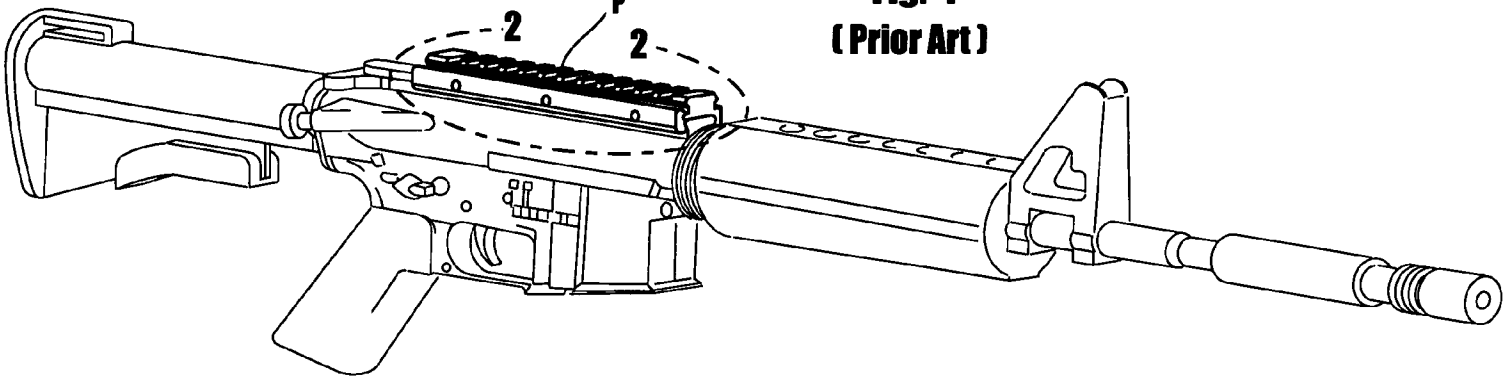
Fig. 1 ( Prior Art )
FIG. 1 is a generally perspective view of one form of prior art weapon having a mounting rail mounted on the barrel thereof.
Figure 2:
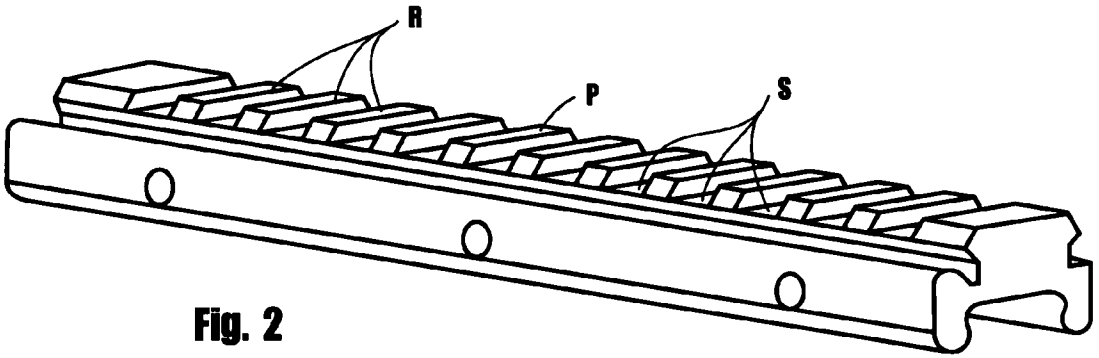
Fig. 2 ( Prior Art )
FIG. 2 is a greatly enlarged generally perspective view of the area identified in FIG. 1 as 2-2.

Referring to the drawings and particularly to FIG. 1, one form of prior art firearm construction is there shown. Mounted on the barrel of the firearm shown in FIG. 1 is a conventional Picatinny mounting rail "P". FIG. 2 is an enlarged generally perspective view of a conventional Picatinny mounting rail. As previously mentioned, the Picatinny rail comprises a series of ridges "R" with a T-shaped cross-section interspersed with flat spacing slots "S". Tactical accessories are generally mounted on the rail either by sliding them on from one end or the other, by means of a so called "rail-grabber" which is clamped to the rail with bolts, by thumbscrews or levers, or onto the slots between the raised sections.

In order to provide a stable platform, the Picatinny rail is provided with the spacing slots that give the rail considerable room to expand and contract lengthwise without distorting its shape. The Picatinny locking slot width is 0.206 in (5.232 mm). The spacing of slot centers is 0.394 in (10.008 mm) and the slot depth is 0.118 in (2.997 mm).

A somewhat similar prior art mounting rail is the Weaver rail. The only differences between the Picatinny rail and the Weaver rail are the size of these slots and the fact that they are standardized.

Figure 3:
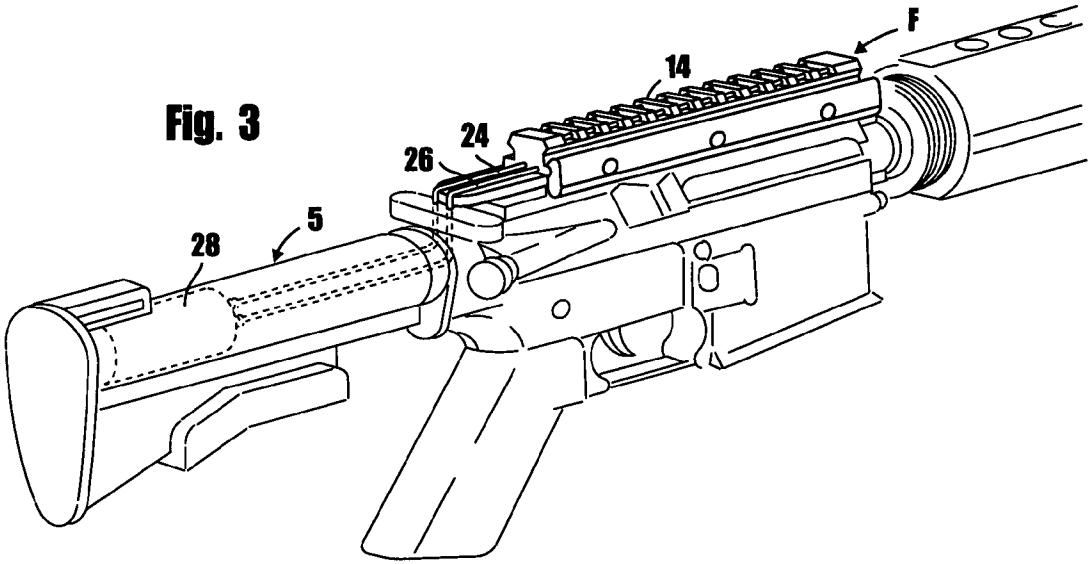
FIG. 3 is a generally perspective fragmentary rear view of one form of the weapon of the present invention having a modified mounting rail affixed thereto.
Figure 4:
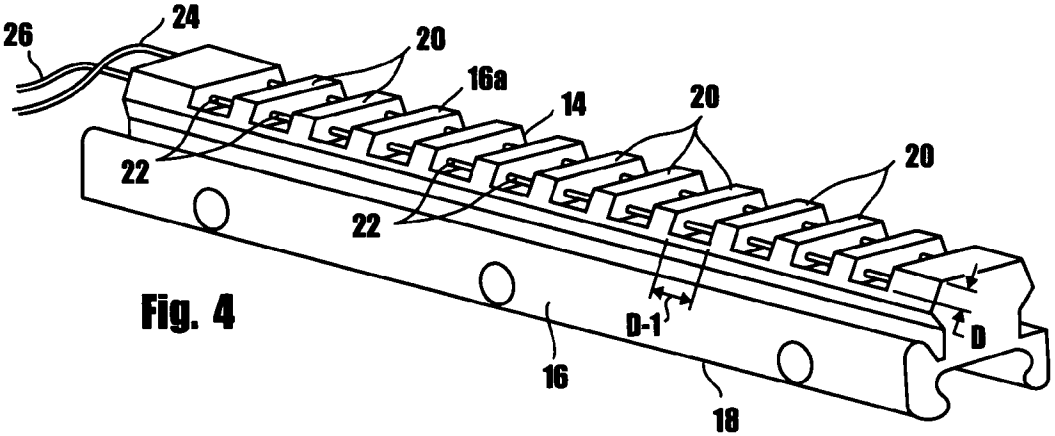
FIG. 4 is a greatly enlarged fragmentary view of the modified mounting rail of the invention.

As shown in FIGS. 3 and 4 of the drawings, the modified rail of the present invention can be seen to be somewhat similar in construction to the prior art Picatinny mounting rail shown in FIGS. 1 and 2 of the drawings. More particularly, one form of the apparatus of the present invention, which is specially designed for mounting an electrically powered tactical device on a firearm, can be seen to comprise a longitudinally extending mounting rail 14 that is affixed to a rail mounting portion of the firearm "F". As best seen in FIG. 4 of the drawings, mounting rail 14 has a body portion 16 that includes a base 18 and a plurality of spaced apart ridges 20 that extend outwardly from the base. Ridges 20 define a plurality of longitudinally spaced apart grooves 22 that extend in a transverse direction. In the preferred form of the invention, grooves 22 have a depth "D" of about 2.997 mm, and ridges 20 are spaced apart by a distance "D-1", which is between about 4.572 mm and about 5.232 mm (see FIG. 4).

Figure 6:
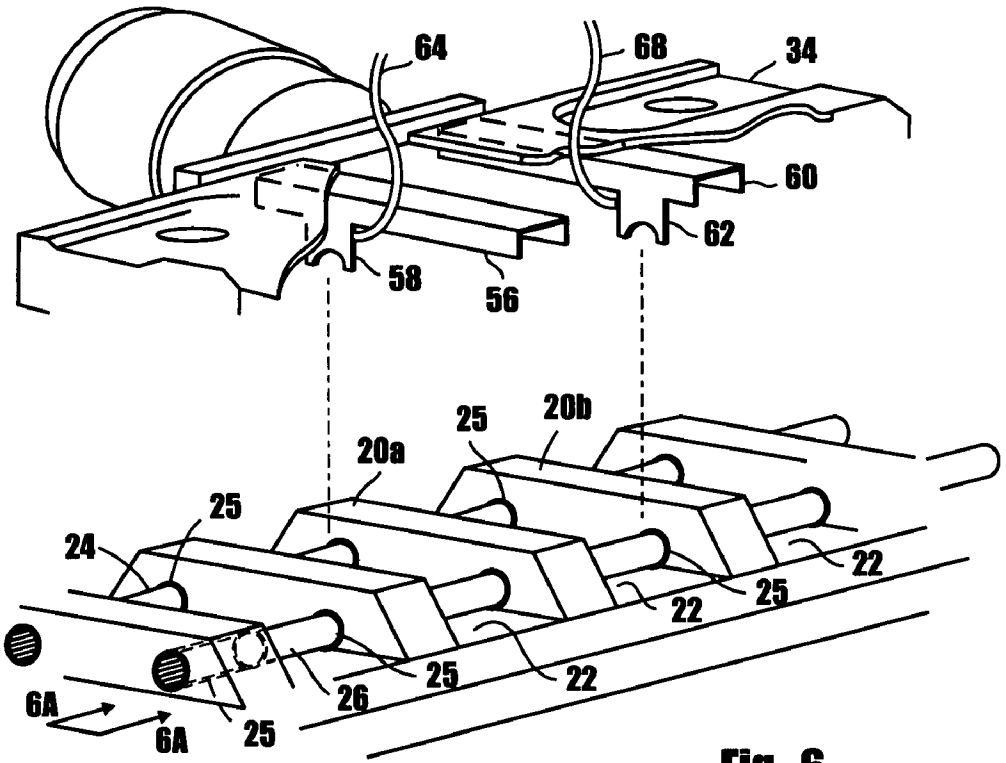
FIG. 6 is a generally perspective exploded view of the red dot pointing light illustrating the manner of its attachment to the modified mounting rail of the invention.
Figure 6A:
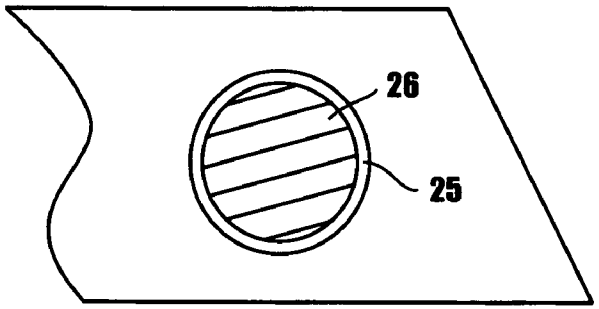
FIG. 6A is a greatly enlarged view taken along lines 6A-6A of FIG. 6.

An important aspect of the apparatus of the present invention resides in the provision of first and second electrical connectors 24 and 26 that extend through longitudinal bores provided in the plurality of spaced apart ridges 20 of the mounting rail (FIG. 4). As indicated in FIG. 3 of the drawings, electrical connectors 24 and 26 extend rearwardly from the mounting rail, through the stock portion "S" of the firearm and are interconnected in a conventional manner to a long life, dry cell battery 28 that is mounted in the stock portion "S" of the firearm. In the form of the invention shown in FIGS. 3 and 4 of the drawings, first connector 24 comprises a hot conductor in the form of an electrically conductive, partly insulated copper wire, while second electrical connector 26 comprises a neutral conductor in the form of an electrically conductive, partly insulated copper wire. For a reason presently to be discussed, and as illustrated in FIGS. 6 and 6A, in each of the longitudinal bores provided in the plurality of spaced apart ridges, wires are covered with insulation 25 at each location where the wire passes through the longitudinal bores. Insulation 25 is of a character that insulates the wire from the ridge through which it passes. Alternatively, insulation such as insulation 25 can be provided on the connectors 24 and 26 at spaced apart locations at which the connectors pass through the longitudinal bores formed in the spaced apart ridges.

Figure 5:
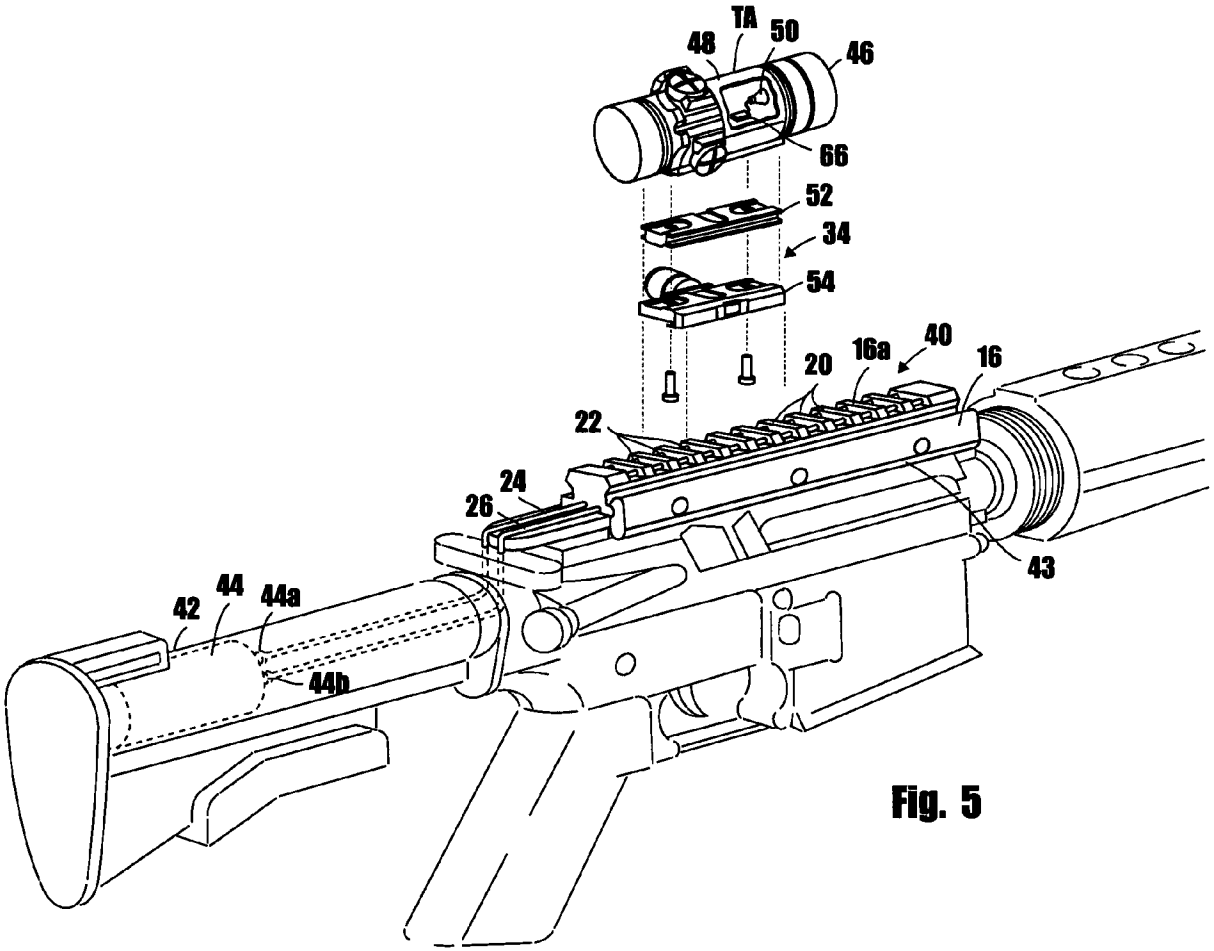
FIG. 5 is a generally perspective rear view similar to FIG. 3, but showing an exploded view of a tactical accessory such as a red dot pointing light that can be mounted on the modified mounting rail of the invention.

With the construction illustrated in FIGS. 3 and 4 of the drawings and described in the preceding paragraphs, various types of modified tactical accessories can be interconnected with and powered by the electrified mounting rail of the present invention. As previously mentioned, many types of prior art tactical accessories are powered by small batteries that comprise a part of the tactical accessory. FIGS. 5 and 6 of the drawings illustrate the modification of one form of tactical accessory "TA", such as a conventional prior art red dot light, so that the accessory can be used with the form of electrified mounting rail of the present invention illustrated in FIGS. 3 and 4 of the drawings. More particularly, the prior art red dot light accessory has here been modified by removing the internal dry cell battery and replacing it with a connecting platform assembly, such as that it is generally designated in FIGS. 5 and 6 of the drawings by the numeral 34.

FIGS. 5, 6 and 6A illustrate one form of the firearm system of the present invention. This novel firearm system here comprises in combination a firearm 40 having a stock 42 and a connector rail mounting portion 43. Mounted within stock 42 is a conventional dry cell battery generally designated by the numeral 44. A longitudinally extending mounting rail, such as the previously identified mounting rail 14, is affixed to the connector rail mounting portion 43 in the manner illustrated in FIG. 5 of the drawings. As previously described herein, mounting rail 14 comprises a body portion 16 having an upper surface 16*a* and a lower surface 18 and is provided with a plurality of longitudinally spaced apart transversely extending grooves 22. First and second electrical connectors 24 and 26 extend longitudinally of body portion 16 intermediate the upper and lower surface and said lower surfaces of the rail. As indicated in FIG. 5 of the drawings, the first and second electrical connectors 24 and 26 are operably connected with the positive and negative terminals 44*a* and 44*b* of battery 44.

An electrically powered tactical accessory, here specifically identified by the numeral 46, is interconnected with the mounting rail by means of the previously discussed connector subassembly 34, the details of construction of which will presently be described. As illustrated in FIG. 5, tactical accessory 46 here comprises a hollow body portion 48 having disposed there within an electrically powered component, here shown as a light source 50.

Connector subassembly 34 is connected to body portion 48 in the manner illustrated in FIG. 5 of the drawings and functions to interconnect the electrically powered component, or light source 50, with the first and second electrical connectors 24 and 26. Connector assembly 34 here comprises a connector base 52 which is connected to hollow body portion 48 by any suitable means (FIG. 5). An interface assembly 54 is, in turn, interconnected with connector base 52 in the manner indicated in FIG. 5 of the drawings. Forming a part of interface assembly 54 is a first connector bracket 56 that is uniquely designed to engage a selected one of the ridges of the mounting rail 16; in this instance, the rail identified in FIG. 6 by the numeral 20*a*. As best seen in FIG. 6 of the drawings, first connector bracket 56 has a downwardly extending connector tab 58 that is specially configured to engage and make electrical contact with the first electrical connector 24 of the mounting rail.

Figure 7:
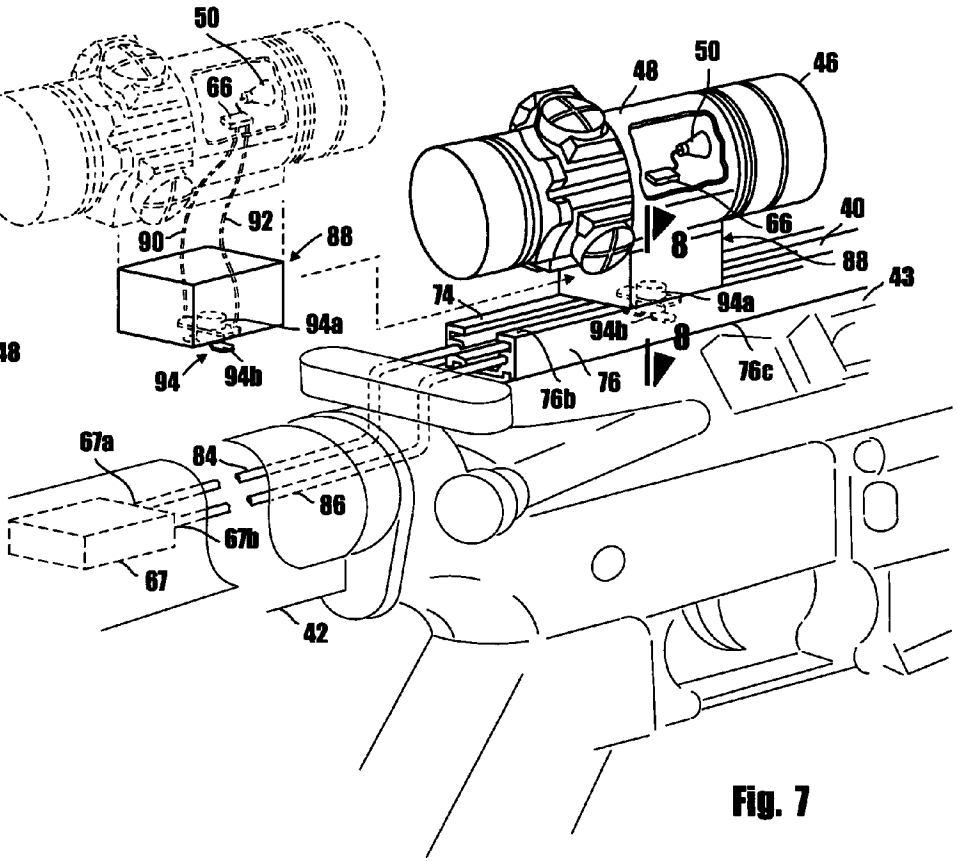
FIG. 7 is a fragmentary generally perspective view showing the tactical accessory of FIG. 6 mounted on the modified mounting rail.

Also forming a part of interface assembly 54 is a second connector bracket 60 that is similar in construction to connector bracket 56 and is also uniquely designed to securely engage a selected one of said ridges of the mounting rail 16, in this instance the rail identified in FIG. 6 by the numeral 20*b*. As best seen in FIG. 6 of the drawings, second connector bracket 60 has a downwardly extending connector tab 62 that is specially configured to engage and make electrical contact with the second electrical connector 26 of the mounting rail. An electrical conduit 64 interconnects connector tab 58 of the first connector bracket with the electrically powered component of the tactical accessory via conventional circuit board 66 that is housed within hollow body portion 48 (FIG. 7). Similarly, an electrical conduit 68 interconnects connector tab 62 of the second connector bracket with the electrically powered component of the tactical accessory via the conventional circuit board 66 (FIG. 5). With the construction thus described, when the connector brackets are interconnected with the selected ridges of the mounting rail 16, power will be supplied to the electrically powered component of the tactical accessory by the battery 44 via the first and second electrical connectors 24 and 26, via tabs 58 and 62 that are in engagement with the electrical connectors, via conductors 64 and 68 and via the circuit board 66 that, in this case, is appropriately interconnected with a source of light 50 in a manner well understood by those skilled in the art. It is to be appreciated that, since the entire rail is electrified, the selected electrically powered tactical accessory can be interconnected with the electrified rail at any desired location along entirely rail. This important feature permits interconnection with the electrified rail of a wide variety of differently configured electrically powered tactical accessories.

Figure 8:
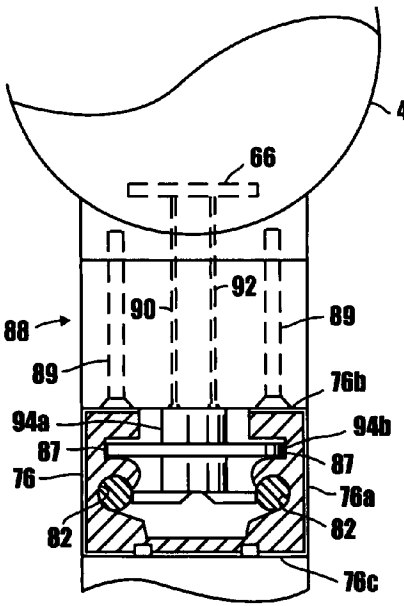
FIG. 8 is a greatly enlarged cross-sectional view taken along lines 8-8 of FIG. 7.

Turning next to FIGS. 7 and 8 of the drawings, an alternate form of weapon system of the invention is there illustrated. The system is similar in many respects to the previously described weapon system and like numerals are used in FIGS. 7 and 8 to identify like components. The firearm system of this latest form of the invention comprises in combination a firearm 40 having a stock 42 and a connector rail mounting portion 43. Mounted within stock 42 is a conventional dry cell battery generally designated by the numeral 67. Battery 67 is of a slightly different configuration from the earlier identified battery 44. More particularly, battery 67 comprises a nickel/cadmium battery, in which cadmium metal serves as the anode and nickel oxide serves as the cathode in an alkaline medium. Battery 67 can be removed from the firearm stock and can be recharged in a manner well understood by those skilled in the art. Batteries 44 and 67 are readily commercially available from a number of sources including TNR Technical, Inc. of Sanford, Fla.

This latest form of the weapon system of the invention includes a differently configured, longitudinally extending mounting rail generally identified by the numeral 74 and is affixed to the connector rail mounting portion 43 of the manner illustrated in FIG. 7 of the drawings. Mounting rail 74 comprises a body portion 76 having an insulating outer shell 76*a*, an upper surface 76*b* and a lower surface 76*c* (FIG. 8). As best seen in FIG. 8, body portion 76, which is of a generally track-like construction, is provided with a first pair of transversely spaced apart, longitudinally extending channels 82 that are disposed intermediate the upper and lower surfaces and extend longitudinally of the track in spaced apart relationship. First and second electrical connectors 84 and 86 are positioned within channels 82 and extend longitudinally thereof. As indicated in FIG. 7 of the drawings, the first and second electrical connectors 84 and 86 are operably connected with the positive and negative terminals 67*a* and 67*b* of battery 67. As best seen in FIG. 8 of the drawings, body portion 76 is also provided with a second pair of transversely spaced apart, longitudinally extending grooves 87 that are disposed intermediate the upper and lower surfaces.

An electrically powered tactical accessory, here specifically identified by the numeral 46, is interconnected with the mounting rail 74 by means of a differently configured connector subassembly 88, the details of construction of which will presently be described. As in the previously described embodiment of the invention, tactical accessory 46 here comprises a hollow body portion 48 having disposed there within an electrically powered component, here shown as a light source 50 and circuit board 66 of conventional construction.

Connector subassembly 88 is connected to body portion 48 by any suitable means such as threaded connectors 89 (FIG. 8) and functions to interconnect the electrically powered component, or light source 50, with the first and second electrical connectors 84 and 86. Connector assembly 88 here comprises a connector housing 92 to which a twist on connector clip subassembly 94 is connected. Clip subassembly 94, which is similar in construction and operation to the twist on connectors provided on conventional incandescent light tracks, is removably receivable within grooves 87 of rail 74 in a manner illustrated in FIG. 8. Clip subassembly 94 here comprises a base 94*a* to which a twist-on clip 94*b* can be connected. Twist-on clip 94*b* can be continuously adjustably positioned along the length of the longitudinally extending grooves 87 in a manner to make electrical contact with the grooves when so attached. More particularly, twist on clip 94*b* has transversely extending, resiliently deformable edge portions that are so constructed and arranged that as the edge portions are inserted into the grooves 87 and twisted there within, the edge portions will be resiliently biased into the grooves so as to make a positive electrical contact with the grooves. Since grooves 87 are, in turn, in electrical contact with the first and second electrical connectors 84 and 86 that are positioned within channels 82, current can flow from the battery 67 toward the tactical accessory 46 via electrical connectors 84 and 86, via twist-on clip 94*b*, via base 94*a* and via electrical conduits 90 and 92 that interconnect base 94*a* with circuit board 66 (see FIG. 7). Twist-on clips 94*b* are readily commercially available from several sources including Erico International Corporation of Solon, Ohio. Once again, it is to be appreciated that, due to the novel design of the uniquely configured electrified mounting rail 74, the selected electrically powered tactical accessory can be interconnected with the mounting rail at any desired location along its entire length. This important feature permits interconnection with the electrified mounting rail of a wide variety of differently configured electrically powered tactical accessories.

Figure 9:
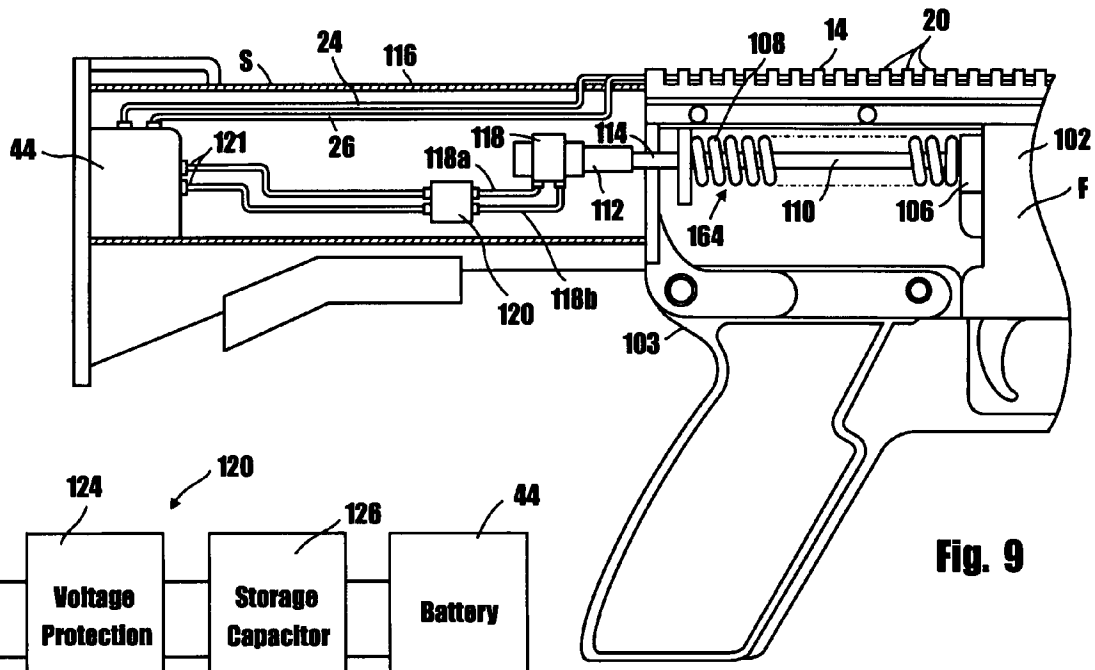
FIG. 9 is a fragmentary cross-sectional view, partly broken away to show internal construction, of an alternate form of the weapon of the present invention having a modified mounting rail affixed thereto and including within the stock of the weapon a dry cell battery and means for charging the dry cell battery.
Figure 10:
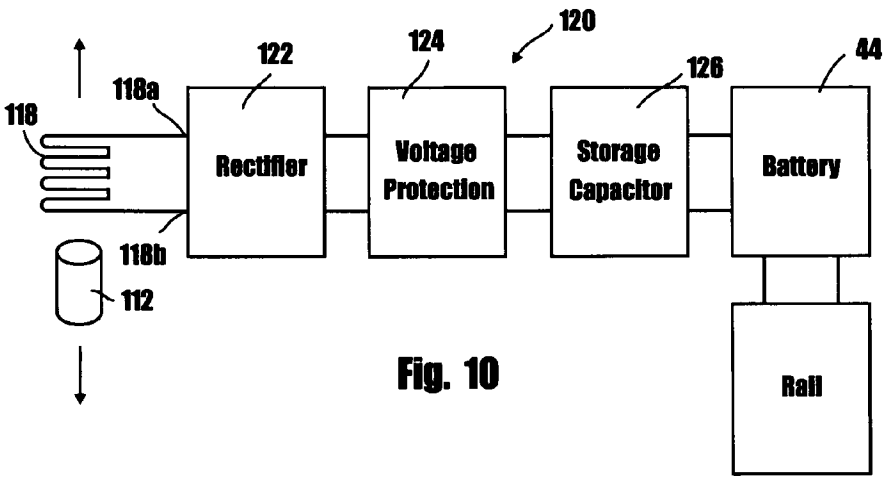
FIG. 10 is a generally diagrammatic view illustrating one form of the electrical circuitry of the means of the invention for charging the dry cell battery.

Turning next to FIGS. 9 and 10 of the drawings still another form of firearm construction of the present invention is there shown. This form of the invention is similar in many respects to that illustrated in FIGS. 1 through 8 of the drawings and like numerals are used in FIGS. 9 and 10 to identify like components. The primary difference between this latest form of the invention and those earlier described herein resides in the fact that, in addition to the dry cell battery being mounted within the stock "S" of the weapon, novel charging means for controllably charging the dry cell battery is also mounted within the stock of the weapon.

As before, this latest form of the invention is specially designed for mounting an electrically powered tactical device on a firearm and comprises a longitudinally extending mounting rail 14 of the character previously described that is affixed to a rail mounting portion of the firearm "F". First and second electrical connectors 24 and 26 extend through longitudinal bores provided in the plurality of spaced apart ridges 20 of the mounting rail, extend rearwardly from the mounting rail, through the stock portion "S" of the firearm and are interconnected in a conventional manner to a conventional rechargeable battery, such as a nickel/cadmium battery 44.

The firearm "F" illustrated in FIG. 9 of drawings is of conventional construction and comprises an upper receiver 102 and lower receiver 103. In addition to previously mentioned rail mounting portion of the firearm, the upper receiver 102 includes a conventional bolt assembly 104 having a bolt 106, which when the firearm is fired, reciprocally moves between a first forward position and a second rearward position. Bolt assembly 104 also includes a biasing spring 108 that circumscribes a guide rod 110 for yieldably resisting movement of the bolt between the first forward position and the second rearward position.

In this latest embodiment of the invention, the novel charging means of the invention comprises an elongated, generally cylindrically shaped permanent magnet 112 that is mounted within the stock "S" in the manner shown in FIG. 9 of the drawings. Magnet 112 is interconnected with bolt assembly 104 by an elongated connector rod 114 so that as the bolt assembly reciprocally moves between the first forward position and the second rearward position, magnet 112 will also reciprocally move between first and second positions within a chamber 116 formed in firearm stock.

Also forming a part of the charging means of the invention is a coil 118 of electrically conductive wire that circumscribes chamber 116 and also circumscribes magnet 112 when the magnet is in position within chamber 116. Coil 118 has first and second extremities 118*a* and 118*b* that are interconnected with charger electronics generally designated in FIG. 9 by the numeral 120. Charger electronics 120 are housed within the firearm stock and are operably connected to battery 44 by electrical connectors 121.

In the present form of the invention the charger electronics 120 comprises a conventional rectifier 122 to which the first and second extremities 118*a* and 118*b* of the coil 118 are interconnected in the manner shown in FIG. 10. Rectifier 122 is interconnected with a conventional voltage protection device 124 that is, in turn, connected to a conventional storage capacitor 126. Storage capacitor 126 is operably connected to battery 44 in the manner illustrated in FIG. 10 of the drawings. The manner of interconnection of the various components of the charger electronics is well understood-by those skilled in the art.

In use, as the firearm is fired, the bolt 106 will reciprocate in a conventional manner causing the magnet 112 to concomitantly reciprocate within coil 118. The reciprocation of the magnet 112 within the coil 118 will generate an electrical current that can be used to recharge the battery 44. More particularly, the electrical current, thusly generated, will flow from the coil 118 toward the charger electronics via the first and second extremities 118*a* and 118*b* of the coil and then on to the battery 44 in the manner indicated in FIG. 10 of the drawings.

Figure 11:
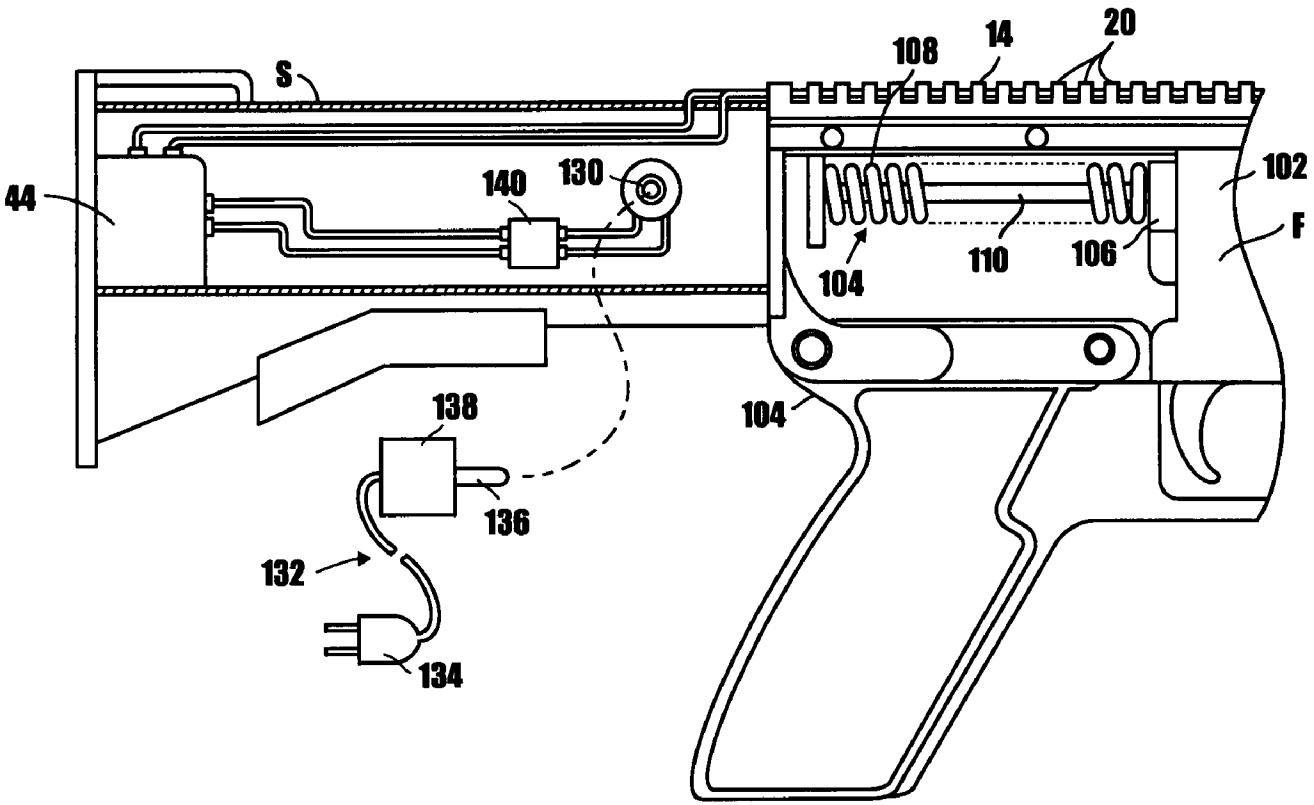
FIG. 11 is a fragmentary cross-sectional view, partly broken away to show internal construction of yet another form of the weapon of the present invention, having a modified mounting rail affixed thereto and including within the stock of the weapon a dry cell battery and an alternate form of the means for charging the dry cell battery.

Referring now to FIG. 11 of the drawings, yet another form of firearm construction of the present invention is there shown. This form of the invention is similar in some respects to that illustrated in FIGS. 9 and 10 and like numerals are used in FIG. 11 to identify like components. The primary difference between this latest form of the invention and that of FIGS. 9 and 10 resides in the fact that, in addition to the dry cell battery being mounted within the stock of the weapon, an alternate type of charging means for controllably charging the dry cell battery is also mounted within the stock "S" of the weapon. In this latest form of the invention, the charging means comprises a conventional, readily commercially available plug-in type power input connector 130 mounted in the stock. A conventional, readily commercially available converter means, shown here as an alternating to direct current converter assembly 132, is connected to the power input connector 130 in a conventional manner. Converter assembly 132 here includes plug 134 that can be connected to an alternating current outlet, a male connector plug 136 that can be connected to the power input connector 130 and a conventional transformer 138.

Power input connector 130 is connected to charger electronics 140 that is carried by stock "S" for operably interconnecting the power input connector 130 with the battery 44. Charger electronics 140 is of a character well understood by those skilled in the art and comprises an electric circuit that includes suitably interconnected components, such as a rectifier, a filter that removes the noise of the current detected from rectifier and a switching portion that connects or disconnects between the rectifier and the filter in response to a predetermined control signal and an output voltage controller. A suitable circuit for use in the present application is disclosed in U.S. Pat. No. 5,889,382 issued to Jung. U.S. Pat. No. 5,889,382 is hereby incorporated herein by reference as though fully set forth herein.

In using the apparatus of this latest form of the invention, at such time as the battery becomes partially discharged, the converter assembly 132 can be connected to an available alternating current outlet and the male connector plug 136 can be connected to the power input connector 130 so that the battery 44 can be recharged.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. In combination, a mounting apparatus for mounting a tactical device and a firearm, said firearm having a mounting rail portion and a stock portion, said combination comprising:

(a) a longitudinally extending mounting rail affixed to the mounting rail portion of said firearm, said mounting rail having a body portion having an upper surface, a lower surface and a plurality of spaced apart ridges, each said ridge having a longitudinal bore, said body portion being provided with a plurality of longitudinally spaced apart grooves extending in a transverse direction;

(b) first and second electrical connectors extending through said longitudinal bores provided in said spaced apart ridges, said electrical connectors being accessible via selected ones of said longitudinally spaced apart grooves formed in said body portion and being so constructed and arranged as to be electrically interconnected with the tactical device;

(c) a battery carried by said stock portion of said firearm, said first and second electrical connectors being connected to said battery; and (d) a battery charger operably associated with said battery for charging said battery, said battery charger comprising:

(i) a plug-in type power input connector mounted in the stock portion of the firearm;

(ii) an alternating-to-direct current converter assembly connected to said plug-in type power input connector for converting alternating current to direct current, said converter assembly including a plug that can be connected to an alternating current outlet;

(iii) an electric circuit carried by said stock for operably interconnecting said power input connector with said battery.

2. The apparatus as defined in claim 1 in which said first electrical connector comprises a hot conductor and in which said second electrical connector comprises a neutral conductor.

3. The apparatus as defined in claim 1 in which said electrical connectors comprise electrically conductive wires.

4. In combination, a mounting apparatus for mounting a tactical device and a firearm, said firearm having a mounting rail portion and a stock portion, said combination comprising:

(a) a longitudinally extending mounting rail affixed to the mounting rail portion of said firearm, said mounting rail having a body portion having an upper surface, a lower surface and a plurality of spaced apart ridges, each said ridge having a pair of transversely spaced apart longitudinal bores, said body portion being provided with a plurality of longitudinally spaced apart grooves extending in a transverse direction;

(b) first and second electrical connectors extending through said longitudinal bores provided in said spaced apart ridges, said electrical connectors being accessible via selected ones of said longitudinally spaced apart grooves formed in said body portion and being constructed and arranged for electrical interconnection with the tactical device;

(c) a battery carried by said stock portion of said firearm, said first and second electrical connectors being connected to said battery; and (d) a battery charger operably associated with said battery for charging said battery, said battery charger comprising:

(i) a plug-in type power input connector mounted in the stock portion of the firearm;

(ii) an alternating-to-direct current converter assembly connected to said plug-in type power input connector for converting alternating current to direct current, said converter assembly including a plug that can be connected to an alternating current outlet;

(iii) an electric circuit carried by said stock for operably interconnecting said power input connector with said battery;

(e) a tactical accessory interconnected with said longitudinally extending mounting rail, said tactical accessory comprising:

(i) a body portion;

(ii) an electrically powered component housed within said tactical accessory body portion; and (iii) a connector sub-assembly connected to said tactical accessory body portion for interconnecting said electrically powered component with said first and second electrical connectors of said mounting rail, said connector sub-assembly comprising:

a. a connector housing; and b. a connector clip sub-assembly connected to said housing, said connector clip sub-assembly including a twist-on connector removably receivable within said pair of transversely spaced apart, longitudinally extending grooves of said body portion of said longitudinally extending mounting rail to make electrical contact therewith.

* * * * *